US007992234B2

(12) United States Patent
Bates et al.

(10) Patent No.: US 7,992,234 B2
(45) Date of Patent: Aug. 9, 2011

(54) SLIDABLE SEAT ASSEMBLY FOR A BATHTUB

(75) Inventors: Michael R. Bates, Sheboygan Falls, WI (US); Jeffrey F. Tempas, Oostburg, WI (US)

(73) Assignee: Kohler Co., Kohler, WI (US)

( * ) Notice: Subject to any disclaimer, the term of this patent is extended or adjusted under 35 U.S.C. 154(b) by 148 days.

(21) Appl. No.: 12/418,709

(22) Filed: Apr. 6, 2009

(65) Prior Publication Data

US 2010/0251476 A1 Oct. 7, 2010

(51) Int. Cl.
*A47K 3/12* (2006.01)
*A47K 3/022* (2006.01)

(52) U.S. Cl. ..... 4/579; 4/578.1; 4/560.1; 4/559; 4/505; 4/571.1; 114/363; 297/344.18

(58) Field of Classification Search ..... 4/579, 578.1, 4/560.1, 559, 505, 571.1; 297/344.24, 344.18, 297/344.12; 114/363
See application file for complete search history.

(56) References Cited

U.S. PATENT DOCUMENTS 170,762 A * 12/1875 Nye ..... 4/579
390,407 A 10/1888 Sloat
652,289 A * 6/1900 Powell ..... 4/643
3,239,850 A 3/1966 Kiss
3,292,187 A * 12/1966 Bessler ..... 4/578.1
5,090,068 A 2/1992 Zellner
5,475,880 A 12/1995 Guenther
6,035,459 A * 3/2000 Sadek ..... 4/560.1

OTHER PUBLICATIONS 11 pages of an PCT search report dated Aug. 9, 2010 in the corresponding PCT US2010/029748 application.

* cited by examiner

*Primary Examiner* — Gregory Huson
*Assistant Examiner* — Lauren Heitzer
(74) *Attorney, Agent, or Firm* — Quarles & Brady LLP

(57) ABSTRACT

A seat assembly for sliding along opposing rims of a bathtub is disclosed. The seat assembly includes a seat member, a friction element affixed to the seat member so as to extend under the seat member, and a flexible slider affixed to the seat member so as to also extend under the seat member. The slider and friction element are positioned and configured so that in a first state, if the seat member is positioned on the opposing rims without additional weight on the seat member, the slider holds the friction element up off a rim while facilitating sliding of the seat member along a rim. In a second state, if the seat member is positioned on the opposing rims with a human weighing over 50 pounds sitting on the seat member, the friction element can contact the rim and thereby impede sliding of the seat member along a rim.

9 Claims, 3 Drawing Sheets

SLIDABLE SEAT ASSEMBLY FOR A BATHTUB

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to bathtubs and, in particular, to movable seats for use therewith.

Humans usually use bathtubs while standing or lying down in the tub. In the case of standing use, an overhead shower typically supplies the water for washing the user, and the bathtub collects and drains the water. In the case of use when the user is lying down, the user typically partially fills the bathtub with water, and then lies down on the floor of the bathtub to soak in a partially immersed fashion.

However, for those who have difficulty getting up by themselves from a reclining position or standing for prolonged periods (e.g. some disabled or elderly), some tubs have been structured with an integrally molded seat so that those users can sit up a bit higher (rather than all the way down on the tub floor). As a result, getting back up to leave the tub is less difficult.

However, this permanently converts the tub into one which uses up much space for the special seating arrangement. Others living at the same location who might prefer a more conventional bathing experience are precluded from that opportunity in this situation, or must use another bathroom.

Removable seats have therefore been proposed for use with conventional bathtubs. See e.g., U.S. Pat. Nos. 390,407; 5,090,068; 5,475,880; and 6,035,459. However, it is desirable that such seats be relatively lightweight so as to be positionable by even the infirm, yet be able to be fixed in a desired position. Also, it is desirable for such seats to be movable between selected fixed positions depending on what type of bathing is desired, and by whom. Further, it is desirable that such seats not themselves take up additional bathing room inside the basin.

There are a variety of other design constraints as well. For example, U.S. Pat. No. 390,407 requires the user to manually adjust a clamping mechanism. While this helps fix the seat at a particular position, the clamping mechanism is awkward to use.

Also, U.S. Pat. No. 5,090,068 permits the user to slide the seat, but requires a lifting motion to achieve that. The lifting aspect can make this seat assembly more difficult for some infirm to use.

Further, U.S. Pat. No. 5,475,880 requires the user to install a track system. This adds weight, cost and complexity to the assembly.

Moreover, U.S. Pat. No. 6,035,459 requires the user to manually operate a brake to fix the seat. Further, it leaves a vertically extending post which can cause tripping problems in the bathroom.

Hence, a need exists for a removable bathtub seat that is lightweight and inexpensive, easily positioned on bathtub rims, and fixable at selected locations in a highly intuitive and automatic fashion.

SUMMARY OF THE INVENTION

A seat assembly for sliding along opposing rims of a bathtub is disclosed. The seat assembly includes a seat member, a friction element affixed to the seat member so as to extend under the seat member, and a flexible slider affixed to the seat member so as to also extend under the seat member.

The slider and friction element are positioned and configured so that in a first state, if the seat member is positioned on the opposing rims without additional weight on the seat member, the slider can help hold the friction element up off a rim while facilitating sliding of the seat member along a rim. In a second state, if the seat member is positioned on the opposing rims with a human weighing over 50 pounds sitting on the seat member, the friction element can contact the rim and thereby impede sliding of the seat member along a rim.

In one form of the seat assembly, when the seat assembly converts between the first state and the second state, this conversion is due to the slider deflecting and thereby permitting the movement of the friction element relative to a rim until the friction element contacts the rim in a braking fashion.

In another form, there are two such sliders and two such friction elements. In this form, one such slider and one such friction element are positioned at opposed ends of the seat member.

In still another form the seat member is in the form of a slab with downwardly curved opposed ends. A slider is positioned adjacent a downward side of such a downwardly curved end.

In yet another form, the friction element is in the form of two spaced bumpers.

In still yet another form, the friction element comprises of a polymeric material such as PVC or ABS plastic.

In another form, the seat member comprises wood.

Thus, seat assemblies are provided by the present invention that are easily positioned on a bathtub, on opposed rims of the tub. The seat is alternatively slidable or fixed relative to the rims depending on whether or not an individual or other similar weight source is on the seat.

When no user is seated on the seat member, the slider(s) help to hold the friction element(s) from the contacting the rim(s), allowing the seat assembly to slide along the rims with minimal force applied to the seat. When a typical user sits on the seat member, the slider(s) deflect such that the friction element(s) contact(s) the rim(s) thereby impeding the movement of the seat assembly. Hence, once a user positions the seat where desired, merely sitting on it fixes it in place.

Note that these advantages are achieved merely by adding a few lightweight and inexpensive components to a seat slab.

These and still other advantages of the invention will be apparent from the detailed description and drawings. What follows is merely a description of a preferred embodiment of the present invention. To assess the full scope of the invention the claims should be looked to as this preferred embodiment is not intended to be the only embodiment within the scope of the claims.

DETAILED DESCRIPTION OF THE PREFERRED EMBODIMENT

Figure 1:
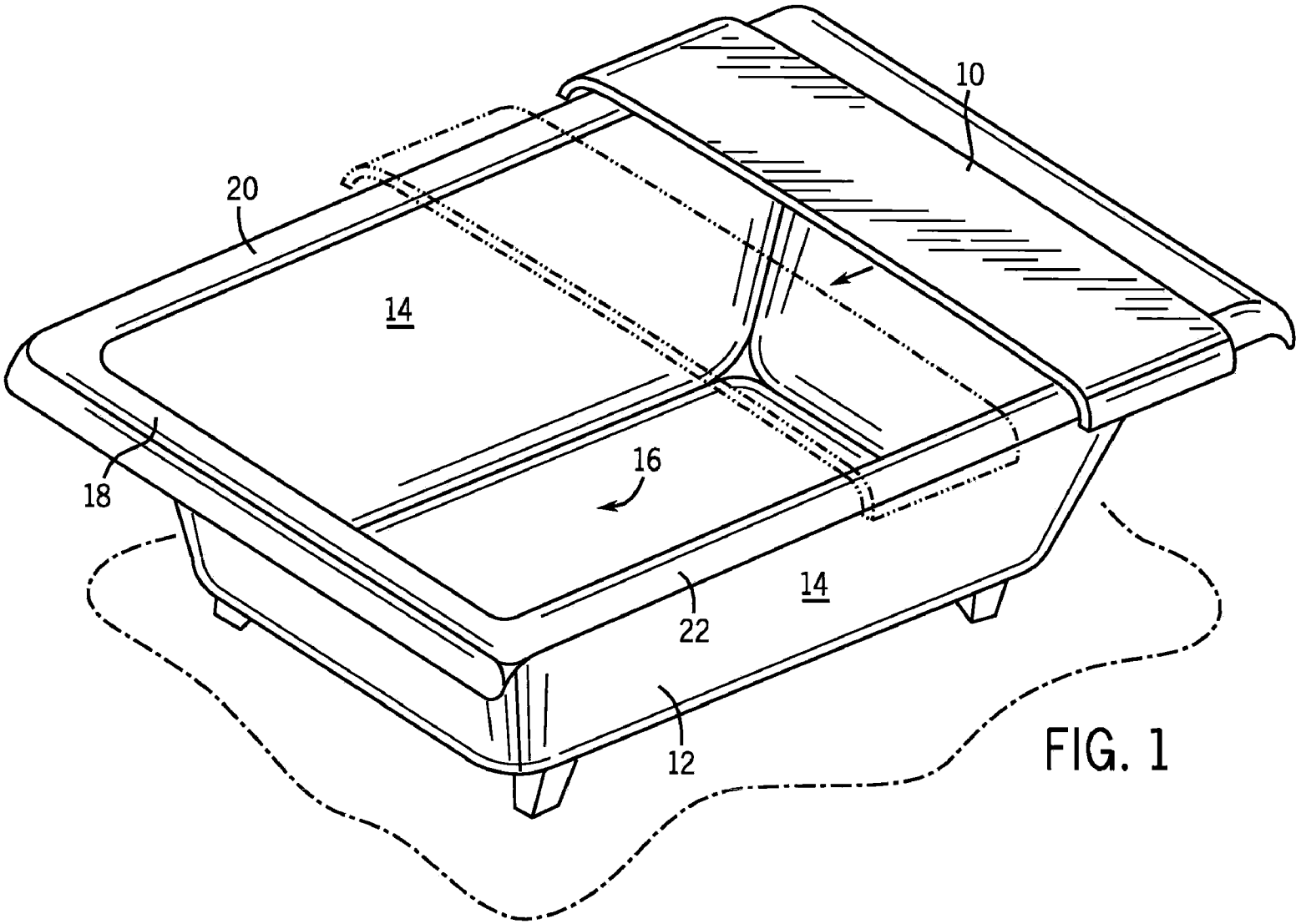
FIG. 1 is an upper, left, frontal perspective view of a seat assembly of the present invention positioned along rims of a bathtub.

Referring first to FIG. 1, a seat assembly 10 is shown resting on a bathtub 12. The bathtub 12 includes opposed walls 14 which in part define a basin 16 for collecting water. The walls 14 extend upward to a surrounding rim 18 that includes two opposing rim sections 20 and 22 which are essentially parallel with one another.

In the FIG. 1 embodiment the rim sections 20 and 22 are shown as somewhat curved. However, they could be horizontally flat, sloped, or otherwise configured.

As is well known, such bathtubs can be made of many materials such as plastics and metals. In the most preferred form, bathtub 12 is a cast iron bathtub that has been enameled.

The seat assembly 10 is (i) slidable along the rim 18 from one position to another position (such as that shown in phantom lines in FIG. 1) when there is no significant additional weight on the seat assembly 10, and (ii) positionable at fixed selected locations along the rim sections 20 and 22 when an individual sits or otherwise applies a sufficient amount of weight on the seat assembly 10.

Figure 2:
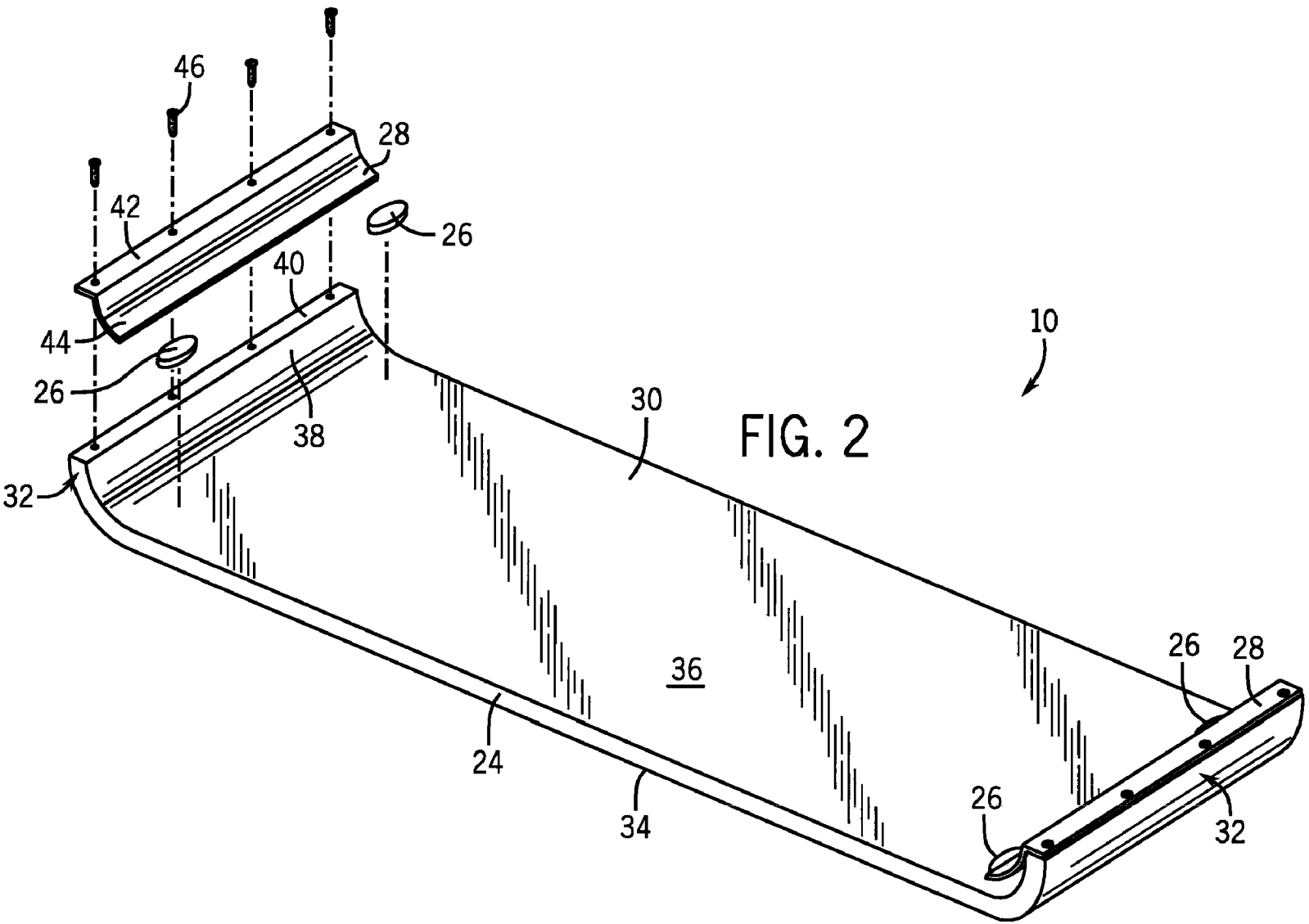
FIG. 2 is a bottom perspective view of the FIG. 1 seat assembly, in which one of the sliders and a set of friction elements are shown in exploded form.
Figure 3:
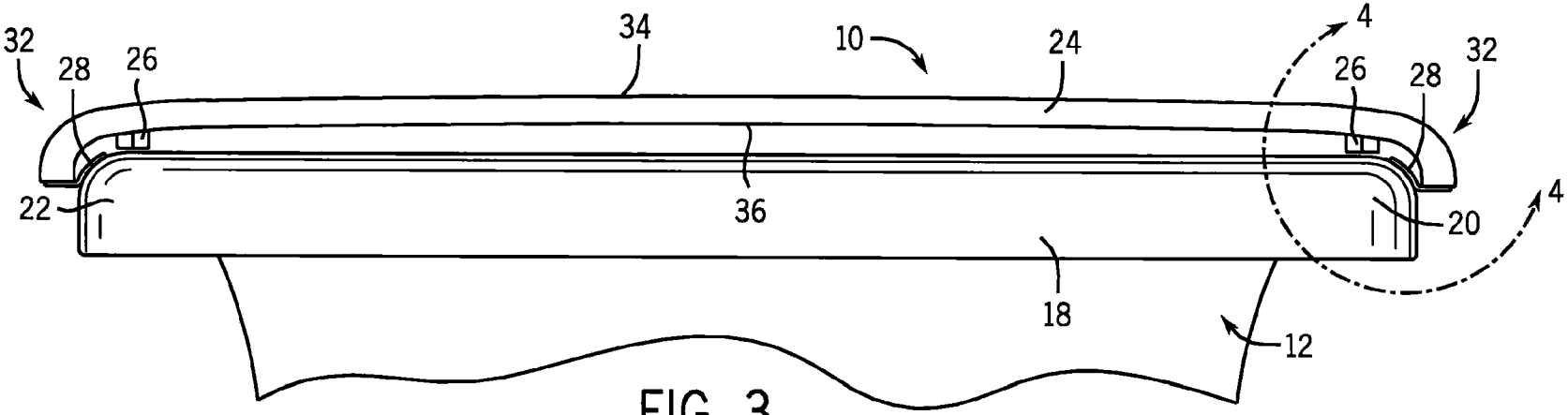
FIG. 3 is a fragmentary right side elevational view of the FIG. 1 seat assembly, positioned along opposed rims of the bathtub.

As best seen in FIGS. 2 and 3, the seat assembly 10 includes a slab-like seat member 24 with affixed friction elements/bumpers 26 and sliders 28. In a preferred form the seat member 24 is a generally rectangular slab 30 with downwardly curved opposed ends 32 on two lateral ends of the slab 30. The slab 30 includes an upper surface 34 for sitting and a bottom surface 36.

Although the upper surface 34 and the bottom surface 36 are shown as being substantially planar between the downwardly curved opposed ends 32, they could include some curvature or include portions formed to serve as a seat recess or the like. Near each downwardly curved end 32, the bottom surface 36 transitions into a curved concave surface 38 and then the slab 30 terminates at a planar surface 40.

The seat member 24 can be made of a wide variety of materials (e.g. wood or plastic). Also, the top surface of the seat member 24 can be textured to minimize slipping on that surface when seated.

The friction elements 26 and sliders 28 are affixed to the seat member 24 so as to extend under the seat member 24. In the form shown, a single slider 28 and a pair of friction elements 26 are affixed near each of the downwardly curved opposed ends 32.

Each of the sliders 28 includes a mounting portion 42 for attaching the slider 28 to the seat member 24 and a flexible support portion 44 for contacting the rim 18 of the bathtub 12. The mounting portion 42 is attached to planar surface 40 at the downwardly curved end 32 using screws 46. The support portion 44 is curved and nests within the curved concave surface 38 of the end 32.

Figure 5:
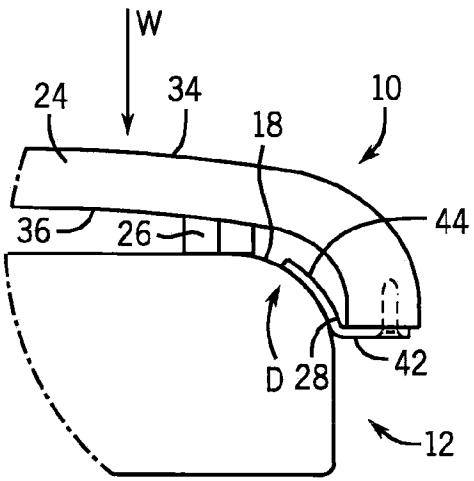
FIG. 5 is a view similar to FIG. 4, but where a human's weight causes the friction element and slider to move as shown.
Figure 4:
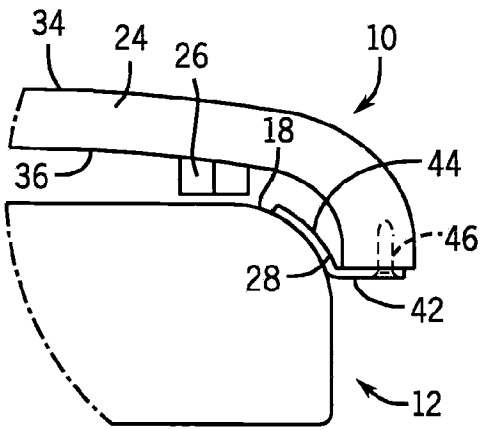
FIG. 4 is a detailed view as indicated in FIG. 3 by lines 4-4.

The friction elements 26 are also affixed to the seat member 24 so as to extend under the seat member 24. As best seen in FIGS. 2, 4, and 5, a pair of friction elements 26 are mounted to the bottom surface 36 of the seat member 24 slightly inward of the corresponding slider 28 such the friction elements 26 are clear of the path of deflection of the support portion 44 of the slider 28. The friction elements 26 could be attached to the seat member 24 in any of a number of ways including, but not limited to, adhesive, fasteners, and the like.

The seat member 24 is sized, and the friction elements 26 and the sliders 28 are positioned and configured, such that the downwardly curved opposing ends 32 are each located near one of the opposing rim sections 20 and 22 when the seat assembly 10 is placed over the bathtub 12.

As best seen in FIGS. 3 and 4, when the seat assembly 10 is placed over the rim 18 of the bathtub 12 and no additional weight is placed on the seat assembly 10, the sliders 28 support the seat member 24 such that the friction elements 26 do not contact/brake against the rim 18. In this state, the seat assembly 10 can readily slide along the opposing rim sections 20 and 22 to position the seat assembly 10 in the bathtub 12.

As best seen in FIG. 5, when a weight "W" is applied to the upper surface 34 of the seat member 24 to move the seat member 24 downward, the sliders 28 deflect according to arrow D such that the friction elements 26 are brought into contact with the opposing rim sections 20 and 22. When the friction elements 26 contact the rim 18, the serve as a brake that holds the seat assembly 10 in place relative to the bathtub 12. In this way, when the weight of a user is applied to the seat assembly 10, the seat assembly 10 is automatically fixed in place.

The configuration and positioning of the sliders 28 and the friction elements 26 relative to the rim 18 would be such that some non-trivial amount of weight would be appropriate to cause the friction elements 26 to engage the rim 18. It is contemplated that a weight of 50 pounds would in most cases be an appropriate amount of weight to cause the braking action of the seat assembly 10, as the weight of a potential user of the seat assembly 10 would exceed 50 pounds.

In the form shown, there are two spaced friction elements 26 on each side of the seat assembly 10. When the sliders 28 deflect by the application of weight, the two friction elements 26 of each side contact the corresponding rim section to provide a total of at least three points of contact and preferably four points of contact as the friction elements or bumpers may elastically deflect. By spreading out the points at which the friction elements 26 engage the rim 18 of the bathtub 12 and including points on the opposing sides of the rim 18 of the bathtub 12, the seat assembly 10 is less likely to slide or twist than if there were only a few or very small points of contact.

As the sliders 28 provide sliding surfaces and the friction elements 26 serve as a brake, the selection of appropriate materials for these parts is important. The sliders 28 should made of a material that allows the sliders 28 to elastically deflect under the specified weight conditions, yet have a relatively low coefficient of friction such that the seat assembly 10 can slide along the rim 18 without damaging the finish of the rim 18.

Particularly preferred slider materials are certain plastics such as polypropylene, PVC or ABS. Alternatively, in some forms the sliders 28 could be made of multiple materials.

The material for the friction elements 26 should likewise be chosen to provide the braking function of the seat assembly 10 without causing damage to the rim 18. It is contemplated that the friction elements 26 may be natural or synthetic rubber bumpers or the like which will grip, but not scratch, any surface finish of the rim 18.

Although one form of the seat assembly has been shown in which the friction elements are inwardly spaced from the sliders, those skilled in the art will appreciate that other positions and configurations of the friction elements and sliders could be used. For example the sliders could be placed on the inside or top of the rim instead of the outside of the rim.

Likewise, the sliders could extend over a greater arc of the rim and the friction elements placed such they would still contact the rim when the sliders deflect.

Thus, the present invention provides lightweight and inexpensive seat assemblies that can be easily positioned along the rims of a bathtub without the need for elaborate securing methods that require manual action of a user or the installation of specialized bathtub kits. When the seat assembly is placed on the rims of a bathtub with no user seated thereupon, the seat assembly can be smoothly slid across the rim. When a user sits on the seat member, the seat assembly becomes automatically fixed relative to the bathtub, thereby providing a stationary seat for the user. When the seat assembly is not being used, it can be easily removed from the bathtub to recover the space for other users.

It should be appreciated that various other modifications and variations to the preferred embodiment can be made within the spirit and scope of the invention. Therefore, the invention should not be limited to the described embodiment. To ascertain the full scope of the invention, the following claims should be referenced.

INDUSTRIAL APPLICABILITY

The invention provides improved adjustable seat assemblies for placement along the rims of a bathtub.

What is claimed is:

1. A seat assembly for sliding along and on opposing rims of a bathtub, the seat assembly comprising:

a seat member;

a friction element affixed to the seat member so as to extend under the seat member; and a flexible slider affixed to the seat member so as to also extend under the seat member;

wherein the slider and friction element are positioned and configured so that:

(i) in a first state, if the seat member is positioned on the opposing rims without additional weight on the seat member, the slider holds the friction element up off the rims while facilitating sliding of the seat member along and on the rims; and (ii) in a second state, if the seat member is positioned on the opposing rims with a human weighing over 50 pounds sitting on the seat member, the human merely sitting on the seat will drive the friction element into contact with the rims and thereby will impede sliding of the seat member along the rims; and wherein there are two such sliders and two such friction elements, one such slider being positioned adjacent each of said opposing rims adjacent ends of the seat member, and one such friction element being positioned adjacent each of opposed ends of the seat member.

2. A seat assembly for sliding along and on opposing rims of a bathtub, the seat assembly comprising:

a seat member;

a friction element affixed to the seat member so as to extend under the seat member; and a flexible slider affixed to the seat member so as to also extend under the seat member;

wherein the slider and friction element are positioned and configured so that:

(i) in a first state, if the seat member is positioned on the opposing rims without additional weight on the seat member, the slider holds the friction element up off the rims while facilitating sliding of the seat member along and on the rims; and (ii) in a second state, if the seat member is positioned on the opposing rims with a human weighing over 50 pounds sitting on the seat member, the human merely sitting on the seat will drive the friction element into contact with the rims and thereby will impede sliding of the seat member along the rims;

wherein when the seat assembly converts between the first state and the second state this conversion is due to the slider deflecting and thereby permitting downward movement of the friction element relative to the rims until the friction element can contact the rims in a braking fashion; and wherein there are two such sliders and two such friction elements, one such slider being positioned adjacent each of said opposing rims adjacent ends of the seat member, and one such friction element being positioned adjacent each of opposed ends of the seat member.

3. The seat assembly of claim 2, wherein the seat member is in a form of a slab with downwardly curved opposed ends.

4. The seat assembly of claim 3, wherein a slider is positioned adjacent a downward side of such a downwardly curved end.

5. The seat assembly of claim 2, wherein both friction elements are in a form of bumpers.

6. The seat assembly of claim 2, wherein both friction elements comprise a polymeric material.

7. The seat assembly of claim 2, wherein the seat member comprises wood.

8. A seat assembly for sliding along and on opposing rims of a bathtub, the seat assembly comprising:

a seat member;

a friction element affixed to the seat member; and a flexible slider affixed to the seat member;

wherein the slider and friction element are positioned and configured so that:

(i) in a first state, if the seat member is positioned on the opposing rims without additional weight on the seat member, seat member is slidable along and on the rims; and (ii) in a second state, if the seat member is positioned on the opposing rims with a human weighing over 50 pounds sitting on the seat member, the human merely sitting on the seat will drive the friction element into contact with at least one of the opposing rims and thereby will impede sliding of the seat member along the rims; and wherein there are two such sliders and two such friction elements, one such slider being positioned adjacent each of said opposing rims adjacent ends of the seat member, and one such friction element being positioned adjacent each of opposed ends of the seat member.

9. The seat assembly of claim 8, wherein when the seat assembly converts between the first state and the second state this conversion is due to the sliders deflecting and thereby permitting downward movement of the friction elements relative to the rims until the friction elements can contact the rims in a braking fashion.

* * * * *